US010107273B2

(12) United States Patent
Witt et al.

(10) Patent No.: US 10,107,273 B2
(45) Date of Patent: Oct. 23, 2018

(54) SYNCHRONIZATION OF SUPPLY FLOW PATHS

(75) Inventors: Klaus Witt, Waldbronn (DE); Konstantin Shoykhet, Waldbronn (DE)

(73) Assignee: Agilent Technologies, Inc., Santa Clara, CA (US)

( * ) Notice: Subject to any disclaimer, the term of this patent is extended or adjusted under 35 U.S.C. 154(b) by 656 days.

(21) Appl. No.: 12/737,677

(22) PCT Filed: Aug. 7, 2008

(86) PCT No.: PCT/EP2008/060387

§ 371 (c)(1),
(2), (4) Date: Feb. 4, 2011

(87) PCT Pub. No.: WO2010/015279

PCT Pub. Date: Feb. 11, 2010

(65) Prior Publication Data

US 2011/0132463 A1 Jun. 9, 2011

(51) Int. Cl.

| | |
|---|---|
| ***G05B 13/02*** | (2006.01) |
| ***F04B 11/00*** | (2006.01) |
| ***F04B 13/02*** | (2006.01) |

(52) U.S. Cl.

CPC ..... *F04B 11/0058* (2013.01); *F04B 13/02* (2013.01); *F04B 2203/0204* (2013.01); *Y10T 137/0318* (2015.04); *Y10T 137/86131* (2015.04)

(58) Field of Classification Search

CPC ..... F04B 11/005; F04B 9/113; F04B 11/0075; F04B 49/106

USPC ..... 137/512, 613, 614.02; 210/101, 198.2, 210/656; 700/282, 289; 73/61.52, 61.56; 417/248, 254, 258, 297, 313, 540

See application file for complete search history.

(56) References Cited

U.S. PATENT DOCUMENTS 4,084,246 A 4/1978 Schwartz
4,576,159 A * 3/1986 Hahn ..... A61M 16/12 128/203.14

(Continued)

FOREIGN PATENT DOCUMENTS

WO 2006/087037 8/2006
WO 2006-087037 A1 8/2006
WO WO 2006087037 A1 * 8/2006

OTHER PUBLICATIONS

International Search Report dated Jun. 2, 2009.
Chinese Office Action dated Jun. 3, 2014.

*Primary Examiner* — Darrin D Dunn

(57) ABSTRACT

A solvent supply system for supplying a composite solvent is described. The solvent supply system comprises a first supply flow path with a first pump unit, the first supply flow path being adapted for supplying a flow of a first solvent to a mixing unit, the first pump unit operating periodically, and a second supply flow path with a second pump unit, the second supply flow path being adapted for supplying a flow of a second solvent to the mixing unit, the second pump unit operating periodically. The mixing unit is adapted for mixing the first and the second solvent and for supplying a composite solvent. The solvent supply system further comprises a control unit adapted for controlling operation of the first and the second pump unit, the control unit being adapted to prevent at least one of a predefined phase relation and a predefined frequency relation between the first pump unit and the second pump unit.

19 Claims, 10 Drawing Sheets

(56) References Cited

U.S. PATENT DOCUMENTS

| | | | | |
|---|---|---|---|---|
| 4,883,409 | A * | 11/1989 | Strohmeier et al. | 417/43 |
| 4,938,396 | A * | 7/1990 | Shannon | 222/641 |
| 5,259,731 | A * | 11/1993 | Dhindsa | F04B 49/065 417/3 |
| 5,447,050 | A * | 9/1995 | Pahnke | B21J 7/14 72/402 |
| 5,755,561 | A * | 5/1998 | Couillard et al. | 417/246 |
| 6,099,724 | A * | 8/2000 | Dourdeville | 210/198.2 |
| 6,364,623 | B1 * | 4/2002 | Ciavarini et al. | 417/53 |
| 6,648,609 | B2 * | 11/2003 | Berger et al. | 417/297 |
| 2003/0213850 | A1 * | 11/2003 | Mayer | G05D 23/1393 236/12.12 |
| 2008/0047611 | A1 * | 2/2008 | Stemer | 137/171 |
| 2009/0139493 | A1 * | 6/2009 | Shafer et al. | 123/500 |
| 2010/0288027 | A1 * | 11/2010 | Ishii et al. | 73/61.56 |

* cited by examiner

SYNCHRONIZATION OF SUPPLY FLOW PATHS

This application is the National Stage of International Application No. PCT/EP2008/060387, filed on Aug. 7, 2008 which designated the United States of America, and which international application was published as Publication No. WO 2010/015279.

BACKGROUND ART

The present invention relates to a solvent supply system for supplying a composite solvent, and to a separation system comprising a solvent supply system. The present invention further relates to a method for supplying a composite solvent.

U.S. Pat. No. 4,883,409 relates to a pumping apparatus for delivering liquid at high pressure. The pumping apparatus comprises two pistons, which reciprocate in pump chambers, respectively. The output of the first pump chamber is connected via a valve to the input of the second pump chamber. The pistons are driven by linear drives, e.g. ball-screw spindles. The stroke volume displaced by the piston is freely adjustable by corresponding control of the angular distance, by which the shaft of the drive motor is rotated during a stroke cycle. The control circuitry is operative to reduce the stroke volume when the flow rate, which can be selected by user at the user interface, is reduced, thus leading to reduced pulsations in the outflow of the pumping apparatus.

DISCLOSURE

It is an object of the invention to provide an improved solvent supply system.

A solvent supply system for supplying a composite solvent according to an embodiment of the present invention comprises a first supply flow path with a first pump unit, the first supply flow path being adapted for supplying a flow of a first solvent to a mixing unit, the first pump unit operating periodically, and a second supply flow path with a second pump unit, the second supply flow path being adapted for supplying a flow of a second solvent to the mixing unit, the second pump unit operating periodically. The mixing unit is adapted for mixing the first and the second solvent and for supplying a composite solvent. The solvent supply system further comprises a control unit adapted for controlling operation of the first and the second pump unit, the control unit being adapted to prevent at least one of a predefined phase relation and a predefined frequency relation between the first pump unit and the second pump unit.

In a solvent supply system comprising two or more supply flow paths, with each supply flow path comprising a respective pump unit, it is proposed to coordinate operation of the pump units in the supply flow paths. In particular, in case each of the supply flow paths comprises a periodically operating pump unit, it is advantageous to coordinate at least one of frequency and phase of the pump units.

For example, there may exist unfavourable frequency relations between the first and the second pump unit that may e.g. cause disturbances of solvent composition. By avoiding these unfavourable frequency relations, a more accurate solvent composition can be obtained.

Furthermore, there may e.g. exist undesired phase relations between the first and the second pump unit that may e.g. cause at least one of pressure fluctuations and fluctuations of solvent composition. By preventing these phase relations, the quality of the solvent flow provided by the solvent supply system can be improved.

Hence, by coordinating operation of the first and the second pump unit in a way that at least one of an unfavourable phase relation and an unfavourable frequency relation is avoided, the quality of the solvent flow provided by the solvent supply system is improved.

For example, said predefined phase relation or said predefined frequency relation between the first pump unit and the second pump unit may cause composition instabilities. By preventing said predefined phase relation or said predefined frequency relation, solvent composition of the composite solvent is stabilized. The improved accuracy of solvent composition may give rise to improved measurement results.

According to a preferred embodiment, the control unit is adapted to prevent a predefined phase relation between the first pump unit's phase and the second pump unit's phase. Preferably, phase relations that are likely to cause problems are determined empirically. Non-favourable phase correlations may e.g. be determined experimentally by varying the relative phase correlation between the first and the second pump unit systematically, while monitoring e.g. pressure or baseline of a detector signal. Then, the relative phase between the two pump units may be controlled in a way that these phase correlations are avoided.

According to a preferred embodiment, the control unit is adapted to prevent a predefined frequency relation between the first pump unit's frequency and the second pump unit's frequency. For example, in case the first pump unit's frequency differs slightly from the second pump unit's frequency, the interference will give rise to a slowly varying modulation of solvent composition. By avoiding frequency relations that lead to slowly varying modulations of solvent composition, the accuracy of solvent composition is improved, which leads to an improved quality of the acquired measurement results. Preferably, said unfavourable frequency relations are determined empirically.

According to a preferred embodiment, the control unit is adapted for adjusting the first pump unit's phase and the second pump unit's phase relative to one another. The first and the second pump unit are not operating independently of one another. Instead, their behaviour is coordinated by a control unit. For example, the control unit may adjust the respective phase of the pump units relative to one another.

Preferably, the control unit is adapted for adjusting a relative phase between the first pump unit's phase and the second pump unit's phase in accordance with a predetermined parameter range. For example, a range of preferred phase relations may be defined. Within these "sweet spots" of preferred phase relations, a stable operation of the solvent supply system is possible, whereby problems caused by unfavourable phase relations are prevented.

According to a preferred embodiment, the control unit is adapted for establishing a preferred frequency ratio of the first pump unit's frequency and the second pump unit's frequency. Also the respective frequencies of the first and the second pump unit are not chosen independently of one another. Instead, the respective frequency ratio is controlled by a control unit. For example, the frequency ratio may be set in a way that problems due to interference between the first pump unit's frequency and the second pump unit's frequency are avoided.

Preferably, the control unit is adapted for establishing a preferred frequency ratio of the first pump unit's frequency and the second pump unit's frequency in accordance with a predetermined parameter range. For example, one or more preferred frequency ratios may be defined in advance. Within these "sweet spots", a stable operation of the solvent supply system is possible, whereby problems caused by unfavourable frequency relations are prevented.

In a preferred embodiment, each of the first and the second pump unit comprises at least one piston pump. A piston pump is an important example of a pump that operates periodically.

According to a preferred embodiment, the control unit is adapted for continuously varying the ratio of the first and the second solvent as a function of time. Preferably, the control unit is adapted for varying the ratio of the first and the second solvent in the composite solvent according to a gradient. By coordinating operation of the pump units in the various supply flow paths, a more precise solvent gradient is produced, with disturbances of solvent composition being considerably reduced.

In a preferred embodiment, the first solvent is water, and the second solvent is an organic solvent. For example, by providing a gradient with an increasing percentage of organic solvent, elution strength of the composite solvent can be continuously increased as a function of time.

According to a preferred embodiment, the first pump unit and the second pump unit are implemented as dual-piston parallel type pumps each comprising two piston pumps operating in parallel. A dual-piston parallel type pump is capable of supplying a steady flow of solvent.

According to an alternative embodiment, at least one of the first pump unit and the second pump unit is implemented as a dual-piston serial type pump comprising a primary piston pump and a secondary piston pump fluidically connected in series.

Preferably, at the first pump unit, the primary piston pump's piston and the secondary piston pump's piston reciprocate at a first frequency, and at the second pump unit, the primary piston pump's piston and the secondary piston pump's piston reciprocate at a second frequency. Further preferably, the primary piston pump's piston and the secondary piston pump's piston of the first and the second pump unit are actuated such that they reciprocate out of phase. Further preferably, a stroke cycle of the primary piston pump is twice a stroke cycle of the secondary piston pump.

During an intake phase of the primary piston pump, solvent is drawn in by the primary piston pump, whereas the secondary piston pump delivers a flow of solvent at the outlet of the dual-piston serial type pump. Then, during the delivery phase of the primary piston pump, the flow of solvent provided by the primary piston pump is partly used for filling the secondary piston pump and partly appears at the outlet of the dual-piston serial type pump.

According to a preferred embodiment, the control unit is adapted for such controlling the first and the second pump unit's frequency that a ratio of the first pump unit's frequency and the second pump unit's frequency is equal to a ratio of integer numbers. For example, small frequency differences between the first pump unit's frequency and the second pump unit's frequency may cause slowly varying modulations of solvent composition, which may lead to unpredictable errors. By setting the ratio of the first pump unit's frequency and the second pump unit's frequency to a ratio m/n, with m and n being integer numbers, it is made sure that small frequency differences between the first pump unit's frequency and the second pump unit's frequency do not occur.

Preferably, the control unit is adapted to control a frequency ratio of the first and the second pump unit's frequency such that heterodyne beats caused by an interference of the first pump unit's frequency and the second pump unit's frequency are avoided.

According to a preferred embodiment, the control unit is adapted for setting the first pump unit's frequency to an integer multiple of the second pump unit's frequency.

According to a preferred embodiment, for varying the flow rate of the first and the second pump unit, the control unit is adapted for continuously varying the respective pump unit's stroke volume, with the first and the second pump unit's frequency being kept constant over predefined intervals of the flow rate. Hence, in case a continuously increasing or decreasing flow of solvent is required, the variation of flow is mainly done by varying the pump unit's stroke volume, with the frequencies of the pump units being kept constant over predefined intervals of the flow rate.

Preferably, for varying the flow rate of the first and the second pump unit, the control unit is adapted for continuously varying the respective pump unit's stroke volume, and for discontinuously varying the first and the second pump unit's frequency in frequency steps, wherein for predefined intervals of the flow rate, the first and the second pump unit's frequency are kept constant. Preferably, to avoid any interference between the first and the second pump unit's respective frequencies, the frequencies are preferably varied in steps.

Further preferably, for varying the flow rates of the first and the second pump unit, the control unit is adapted for continuously varying the respective pump unit's stroke volume, wherein each time a stroke volume becomes too large or too small, the control unit is adapted for changing at least one of the first and the second pump unit's frequency by a frequency step.

According to a preferred embodiment, the control unit is adapted for such controlling the first and the second pump unit's frequency that both before and after a frequency step, a ratio of the first and the second pump unit's frequency is equal to a ratio of integer numbers. By restricting the pump units' frequencies to certain well-defined frequency ratios, interference between the first pump unit's frequency and the second pump unit's frequency is avoided. However, the frequencies may be switched between different frequency ratios, and hence, the pump units can be adapted to a desired flow rate.

According to a preferred embodiment, the control unit is adapted for such controlling a relative phase between the first pump unit's phase and the second pump unit's phase that dispensing of an extra volume of first solvent from the first supply flow path into the second supply flow path (or vice versa) is prevented. It has been observed that for certain phase correlations, an extra volume of first solvent is dispensed from the first supply flow path into the second supply flow path (or vice versa). This extra volume may e.g. cause a pressure peak and a fluctuation of solvent composition. Hence, these phase correlations should be avoided.

According to a preferred embodiment, the solvent supply system is implemented as a part of a microfluidic device.

A separation system according to an embodiment of the present invention comprises a solvent supply system as described above, the solvent supply system being adapted for supplying a composite solvent. The separation system further comprises a separation device adapted for separating compounds of a fluid sample, said fluid sample being introduced to the composite solvent supplied by the solvent supply system. In a separation system, precision of the acquired measurement data strongly depends on the accuracy of the solvent composition delivered by the solvent supply system. By using a solvent supply system according to an embodiment of the present invention, many disturbances of solvent composition can be avoided. Hence, the quality of the acquired data is improved.

Preferably, the composite solvent is used as a mobile phase for separating compounds of a fluid sample.

According to a preferred embodiment, the separation system is one of: a liquid chromatography system, an electrophoresis system, an electrochromatography system.

According to an embodiment of the present invention, a method for supplying a composite solvent comprises: supplying a first solvent to a mixing unit via a first supply flow path, the first supply flow path comprising a first pump unit operating periodically, and supplying a second solvent to the mixing unit via a second supply flow path, the second supply flow path comprising a second pump unit operating periodically. The method further comprises mixing the first and the second solvent, and controlling operation of the first and the second pump unit, wherein at least one of a predefined phase relation and a predefined frequency relation between the first pump unit and the second pump unit is prevented.

Embodiments of the invention can be partly or entirely embodied or supported by one or more suitable software programs, which can be stored on or otherwise provided by any kind of data carrier, and which might be executed in or by any suitable data processing unit. Software programs or routines can be preferably applied for controlling operation of the first and the second pump unit.

BRIEF DESCRIPTION OF DRAWINGS

Other objects and many of the attendant advantages of embodiments of the present invention will be readily appreciated and become better understood by reference to the following more detailed description of embodiments in connection with the accompanied drawing(s). Features that are substantially or functionally equal or similar will be referred to by the same reference sign(s).

FIG. 1 shows a solvent supply system adapted for delivering a composite solvent. The solvent supply system comprises a first supply flow path for supplying a solvent A to a mixing unit, and a second supply flow path for supplying a solvent B to the mixing unit. The first supply flow path for solvent A comprises a reservoir 100 of solvent A, a first pump unit 101, and a first solvent delivery line 102. The second supply flow path for solvent B comprises a reservoir 103 of solvent B, a second pump unit 104, and a second solvent delivery line 105. Both the first solvent delivery line 102 and the second solvent delivery line 105 are fluidically connected to a mixing unit 106.

Figure 1:
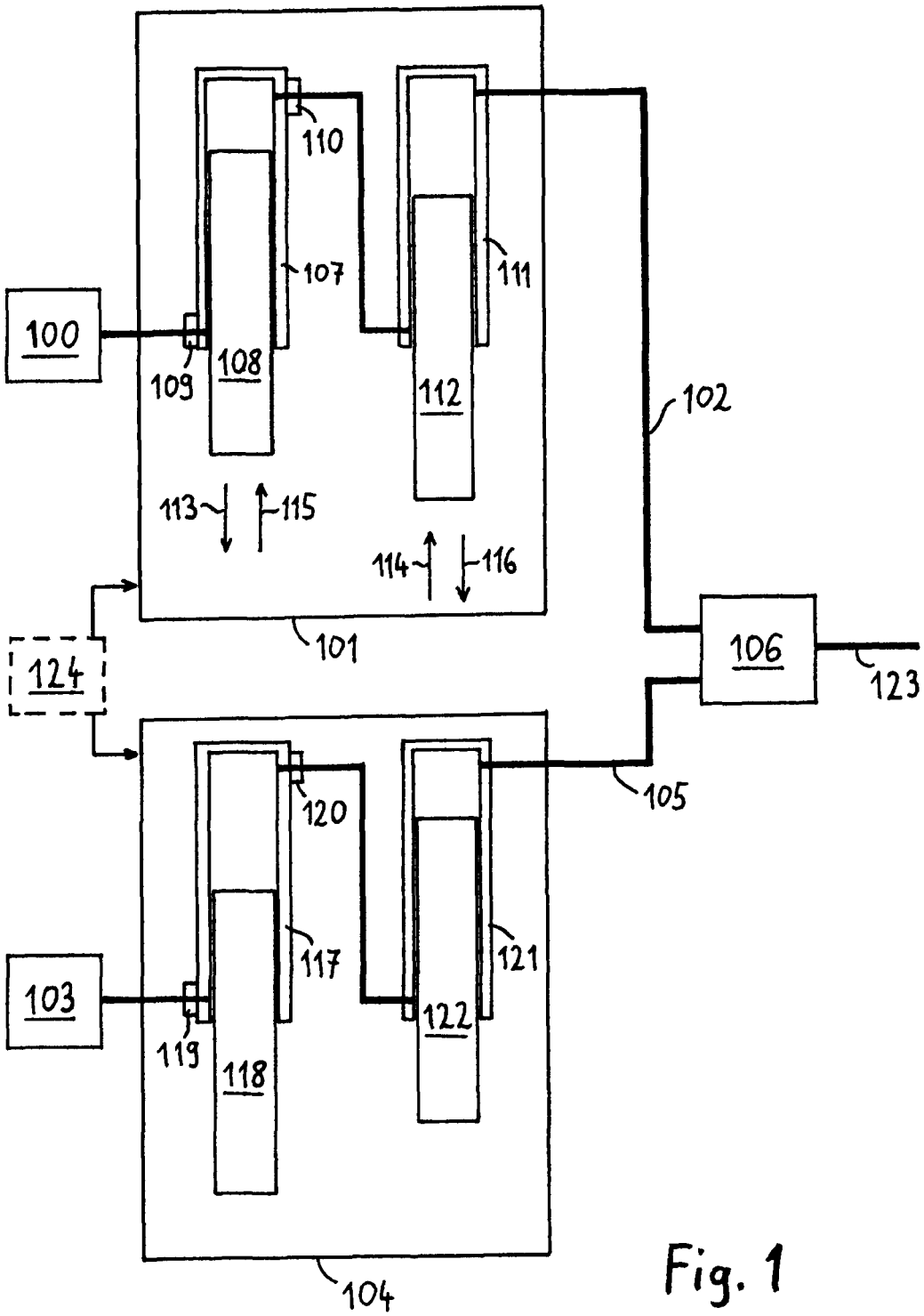
FIG. 1 shows a solvent supply system with two periodically operating pump units.

According to embodiments of the present invention, the pump units 101, 104 are realized as periodically operating pump units. Preferably, each of the pump units 101, 104 comprises at least one piston pump. For example, in the embodiment shown in FIG. 1, each of the pump units 101, 104 is realized as a dual-piston serial type pump comprising two pump heads fluidically connected in series.

In the following, the operation of a dual-piston serial type pump will be explained with regard to the first pump unit 101. The first pump unit 101 comprises a primary pump head 107 with a primary piston 108, an inlet valve 109 and an outlet valve 110, and a secondary pump head 111 with a secondary piston 112. The secondary pump head 111 does not necessarily comprise any inlet or outlet valves. The primary pump head 107 is fluidically connected in series with the secondary pump head 111. In a simple motion pattern the primary piston 108 and the secondary piston 112 are driven 180° out of phase, with the secondary piston 112 being driven at half the speed of the primary piston 108.

During the primary piston's intake phase, the inlet valve 109 is open, and the outlet valve 110 is closed. The primary piston 108 is moved in the downwards direction, as indicated by arrow 113, and solvent from the reservoir 100 is drawn into the primary pump head 107 at a rate equal to twice the nominal flow rate. The secondary piston 112 of the secondary pump head 111 is moved in the upward direction, as indicated by arrow 114, keeping up the flow rate until the primary pump head 107 is filled with liquid. The secondary piston 112 delivers liquid to the system at the nominal flow rate. Hence, during the primary piston's intake phase, a flow of solvent at the nominal flow rate is delivered at the outlet of the secondary pump head 111.

After the primary pump head 107 has been filled with solvent, the inlet valve 109 is closed. The primary piston 108 starts moving in the upward direction, as indicated by arrow 115, whereas the secondary piston 112 moves downwards, as indicated by arrow 116. First, the primary piston 108 compresses the liquid to its final delivery pressure, which may e.g. be several hundred to several thousand bar. Then, the outlet valve 110 is opened, and a flow of solvent is supplied to the secondary pump head 111 at twice the nominal flow rate.

While the primary piston 108 is delivering liquid at twice the nominal flow rate, the secondary piston 112, running backwards, draws off half of that volume. Hence, the flow of solvent provided by the primary pump head 107 is partly used for filling the pump chamber of the secondary pump head 111, and partly appears at the outlet of the secondary pump head 111. Hence, at the outlet of the secondary pump head 111, a flow of solvent at the nominal flow rate is obtained.

The second pump unit 104 is also implemented as a dual-piston serial type pump comprising a primary pump head 117 with a primary piston 118, an intake valve 119 and an outlet valve 120, and a secondary pump head 121 with a secondary piston 122. The primary piston 118 and the secondary piston 122 are driven 180° out of phase, with the secondary piston 122 being driven at half the speed of the primary piston 118.

In the mixing unit 106, the respective flows of solvent A and solvent B provided by the two solvent delivery lines 102 and 105 are mixed, and at the mixing unit's outlet 123, a composite solvent with a certain percentage of solvent A and a certain percentage of solvent B is obtained. Solvent A may e.g. be water, whereas solvent B may e.g. be an organic solvent like e.g. acetonitrile.

The solvent supply system according to an embodiment of the present invention may e.g. be used in the field of liquid chromatography, for supplying a solvent gradient to a high pressure liquid chromatography (HPLC) column. However, the solvent supply system that has been described so far may as well be used in any other application where a precisely defined composition of two or more solvents is needed.

Figure 2:
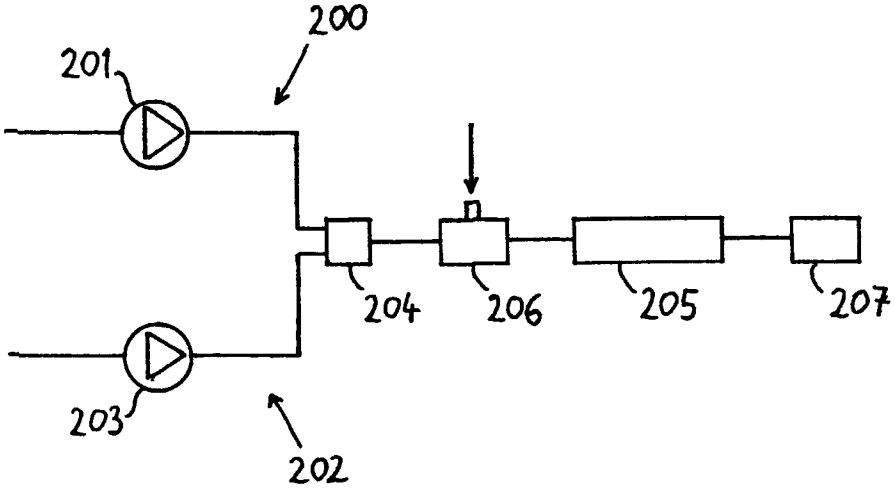
FIG. 2 depicts a liquid chromatography system.

FIG. 2 shows a high pressure liquid chromatography system for separating compounds of a sample. The high pressure liquid chromatography system comprises a first solvent delivery path 200 with a first pump unit 201 and a second solvent delivery path 202 with a second pump unit 203. Both the first solvent delivery path 200 and the second solvent delivery path 202 are fluidically connected with a mixing unit 204. In the embodiment shown in FIG. 2, the outlet of the mixing unit 204 is in fluid communication with a separation column 205. The flow path further comprises an injector unit 206 located upstream of the separation column 205. The injector unit 206 permits introducing a volume of fluid sample, a so-called "plug", into the separation flow path. The flow obtained at the separation column's outlet is supplied to a detection unit 207. The detection unit 207 may e.g. be implemented as a fluorescence detection unit, or as an optical absorbance detection unit adapted for monitoring absorbance intensity of the fluid. Whenever a band of a certain sample component passes the detection unit 207, there will be a corresponding peak in the detection unit's output signal. Peaks may be characterized with respect to their retention time, which is the time at which the center of the band transits the detection unit 207, relative to the time of injection.

The liquid chromatography system may be used in an isocratic mode of operation. In the isocratic mode, a flow of composite solvent is supplied to the separation column 205, whereby the percentage of solvent A and the percentage of solvent B are kept constant as a function of time. In the isocratic mode of operation, solvent composition is selectable but not varied as a function of time.

Alternatively, the liquid chromatography system may be used in a gradient mode of operation. First, a sample to be analyzed is injected, and most of the sample components are trapped on the solid phase at the separation column's head. In the gradient mode, a solvent gradient is applied to the separation column 205, whereby the ratio of solvent A and solvent B in the composite solvent is e.g. continuously varied as a function of time. For example, the initial amount of solvent A, which may e.g. be water, is rather high. Then, during a predefined time interval, the percentage of solvent B is continuously augmented. Solvent B may e.g. be an organic solvent, like e.g. methanol or acetonitrile. Because of the increasing amount of organic solvent, the elution strength of the composite solvent continuously increases, and the various different moieties of the injected sample are consecutively washed to the outlet of the separation column 205. The outlet of the separation column 205 is fluidically connected with the detection unit 207.

Figure 3A:
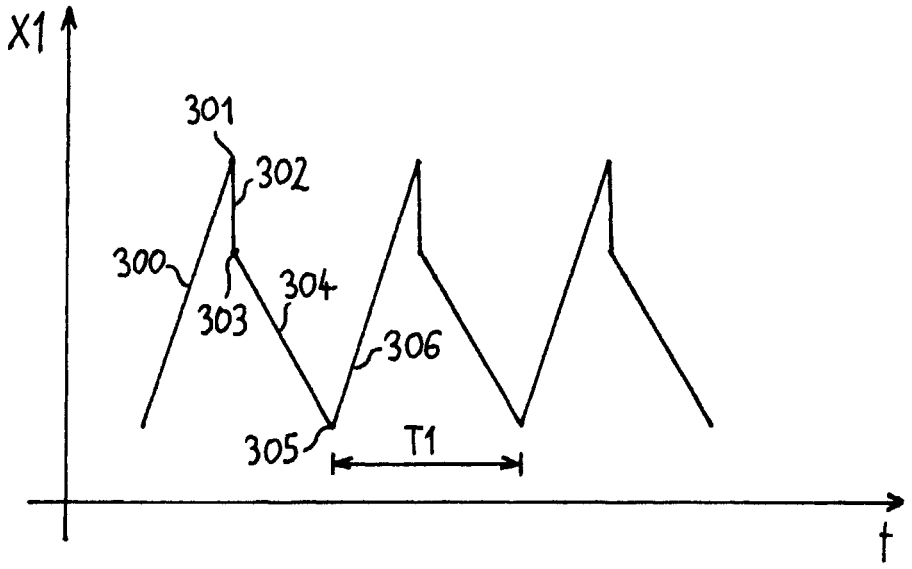
FIG. 3 shows piston position as a function of time for the first and the second pump unit's primary piston.
Figure 3B:
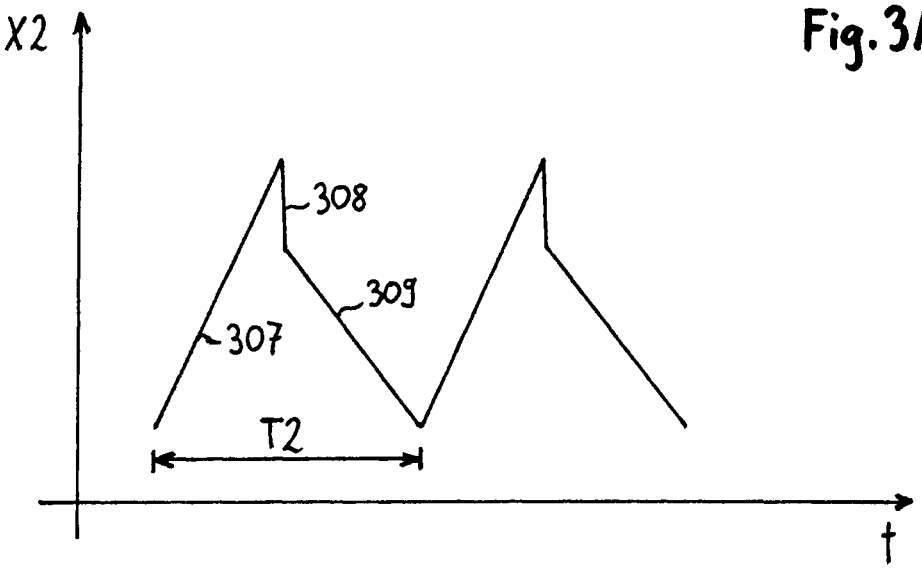

FIG. 3A shows piston position X1 as a function of time for the primary piston 108 of the first pump unit 101. During an intake phase 300, the piston performs a downwards stroke, and liquid is drawn in. At the end of the intake phase 300, the piston reaches its bottom dead center 301, whereby it is to be noted that the piston positions indicated in FIGS. 3A and 3B are rotated 180° relative to the piston positions shown in FIG. 1. During a compression phase 302, the liquid contained in the pump head is compressed to system pressure. At point 303, the final delivery pressure is reached, and the outlet valve 110 is open. During a delivery phase 304, the piston continues moving upwards, and the fluid contained in the first pump head is delivered. At the end of the delivery phase 304, the piston reaches its upper dead center 305. Then, the next intake phase 306 is started.

In FIG. 3A, the time period T1 for one pump cycle of the first pump unit's primary piston 108 is indicated. The primary piston 108 operates at a frequency of f1=1/T1, with T1 denoting the time period for one pump cycle. The secondary piston 112 of the first pump unit 101 operates at the same frequency f1, but is substantially 180° out of phase relative to the primary piston 108, moving half the distance due to the 2:1 speed relation.

FIG. 3B, which is located right below FIG. 3A, shows piston position X2 as a function of time for the primary piston 118 of the second pump unit 104. Again, each pump cycle comprises an intake phase 307, a compression phase 308 and a delivery phase 309. The time period T2 for one pump cycle of the second pump unit's primary piston 118 is indicated. The frequency f2 of the second pump unit 104 is equal to f2=1/T2, with T2 denoting the time period for one pump cycle. The secondary piston 122 of the second pump unit 104 operates at the same frequency f2, but substantially 180° out of phase relative to the primary piston 118, again moving half the distance in this case.

Comparing FIG. 3A and FIG. 3B, it can be seen that the first pump unit's frequency f1 is higher than the second pump unit's frequency f2. Hence, in the example shown in FIGS. 3A and 3B, the pistons 108 and 112 of the first pump unit 101 reciprocate at a higher frequency than the pistons 118 and 122 of the second pump unit 104.

In prior art solutions, for varying the flow rate of solvent A provided by the first solvent delivery line 102, the frequency f1 of the first pump unit 101 has been varied, whereby the stroke volumes have been kept constant. For example, for continuously increasing the flow of solvent A, the frequency f1 of the first pump unit 101 has been continuously increased.

In the same way, for varying the flow rate of solvent B provided by the second solvent delivery line 105, the frequency f2 of the second pump unit 102 has been varied, whereby the stroke volumes have not been varied.

According to the prior art, a solvent gradient of water and an organic solvent may e.g. have been generated by continuously decreasing the frequency f1 of the first pump unit 101 while increasing the frequency f2 of the second pump unit 104. The frequency f1 has been chosen in accordance with the desired flow rate of solvent A, and the frequency f2 has been chosen in dependence on the desired flow rate of solvent B. Hence, in prior art solutions, the frequencies of the first and the second pump unit 101, 104 have been varied independently of one another.

Figure 4:
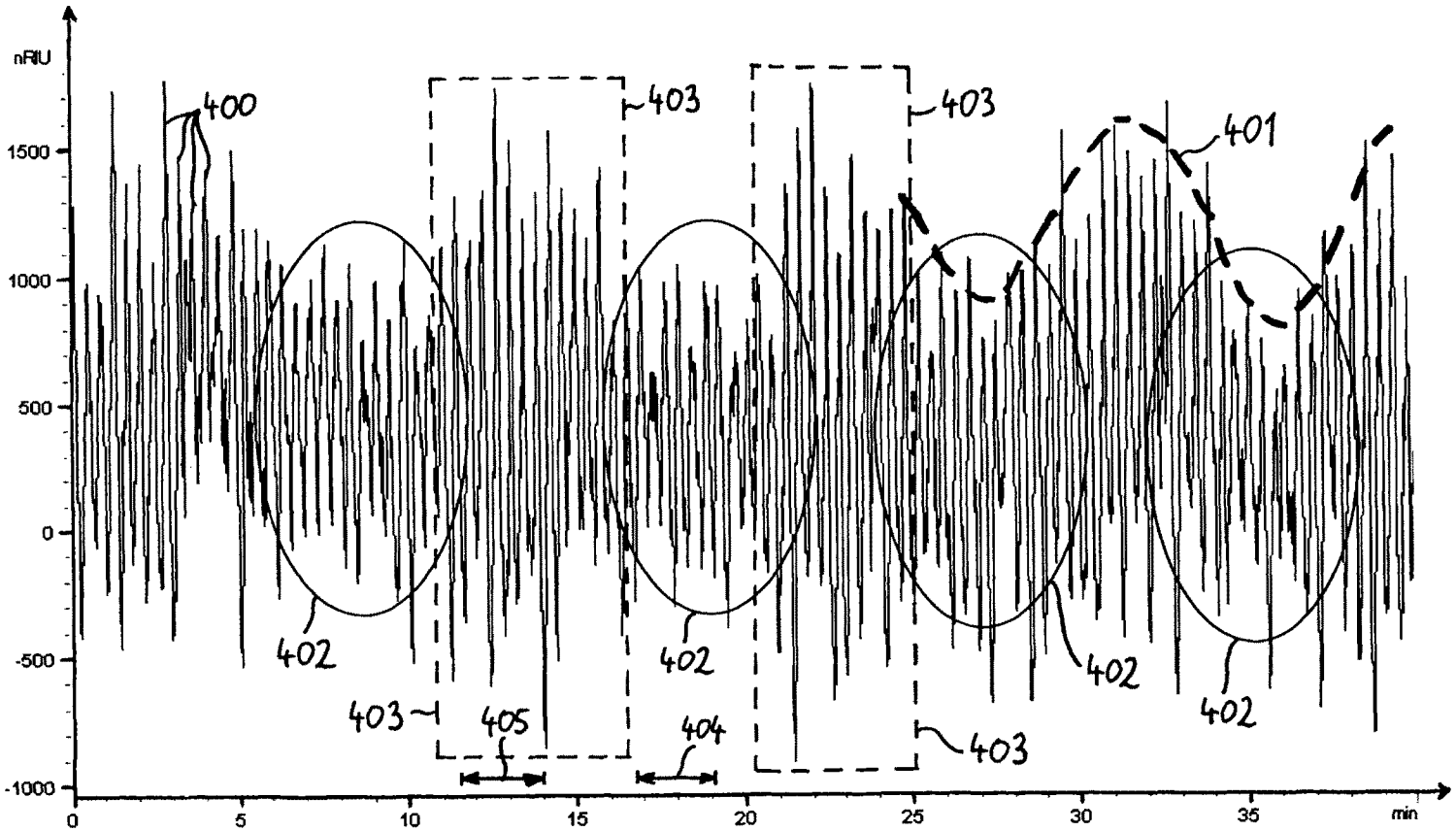
FIG. 4 indicates solvent composition as a function of time at the outlet of the solvent supply system.

FIG. 4 shows a refractive index signal as a function of time for a composite solvent obtained at the outlet of a solvent supply system. The refractive index signal is given in refractive index units (RIUs), as determined by a refractive index detection unit. The refractive index signal indicates solvent composition as a function of time. The composite solvent is supposed to consist of 95% solvent A and 5% solvent B. However, it can be seen that there are variations of solvent composition.

The high frequency oscillations 400 are due to the respective piston movements of the first and the second pump unit 101, 104. However, in addition to the high frequency oscillations 400, there also exists a slowly varying envelope 401 of the refractive index signal with a time period of about 7-10 minutes. The amplitude of the high frequency oscillations 400 varies in accordance with this slowly varying envelope 401. In the regions 402, the amplitude of the refractive index signal is quite small, whereas in the regions 403, the amplitude of the refractive index signal is larger.

The slowly varying envelope 401 of the refractive index signal is caused by an interference between the frequency f1 of the first pump unit 101 and the frequency f2 of the second pump unit 104. The envelope 401 is a heterodyne beat that results from the interference of the frequencies f1 and f2. For example, the frequency f2 may differ slightly from the frequency f1, and the frequency difference (f2−f1) may cause a slowly varying modulation of the refractive index signal. As described above, in the prior art solutions, the frequencies f1 and f2 of the pump units 101 and 104 have been varied independently of one another, which may lead to a heterodyne beat according to the slowly varying envelope 401 shown in FIG. 4.

The variation of the amplitude shown in FIG. 4 has a negative impact on any kind of measurement that depends on the accuracy of the solvent composition, such as e.g. in a HPLC (High Performance Liquid Chromatography) measurement. For example, in case a measurement is performed during a time interval 404, the results will be much more accurate than in case the measurement is performed during a time interval 405. Generally, for obtaining accurate measurement results, it is desirable to keep the variation of solvent composition as small as possible.

Because of the slowly varying envelope 401 shown in FIG. 4, measurements acquired during different time intervals differ considerably, depending on the amplitude of the compositional variations in the respective time interval. In case the measurement interval is chosen in a non-favourable manner, measurement results with a large error are obtained, said error being due to variations of solvent composition.

To avoid any slowly varying oscillation of solvent composition, embodiments of the present invention propose to control the ratio of the frequencies f1 and f2 of the pump units in a way that these slowly varying oscillations do not occur any more. According to embodiments of the present invention, the frequencies f1 and f2 are no longer set independently of one another. Instead, the frequency f1 of the first pump unit 101 in the first supply flow path and the frequency f2 of the second pump unit 104 in the second supply flow path are related to one another. For example, the frequencies f1 and f2 may be controlled in a way that the ratio f2/f1 is equal to a ratio of integer numbers m and n (at least during a certain interval of solvent composition):

$$f2/f1=m/n$$

Thus, small frequency differences between the frequency f1 and the frequency f2 are avoided. Accordingly, heterodyne beats do not occur any more, and hence, the slow amplitude modulation shown in FIG. 4 disappears.

For controlling the respective frequencies of the first pump unit and the second pump unit, the system may e.g. comprise a control unit. In FIG. 1, a control unit 124 (indicated with dashed lines) for controlling the respective frequencies of the first pump unit 101 and the second pump unit 104 is shown.

For generating a solvent gradient, a continuous variation of individual flows in the two solvent delivery lines 102 and 105 is required. According to embodiments of the present invention, a continuous variation of flow is accomplished by continuously varying the stroke length and hence the stroke volume of the piston pumps in the first and the second pump unit, while the frequencies f1 and f2 are kept constant during certain intervals of solvent composition.

Figure 5A:
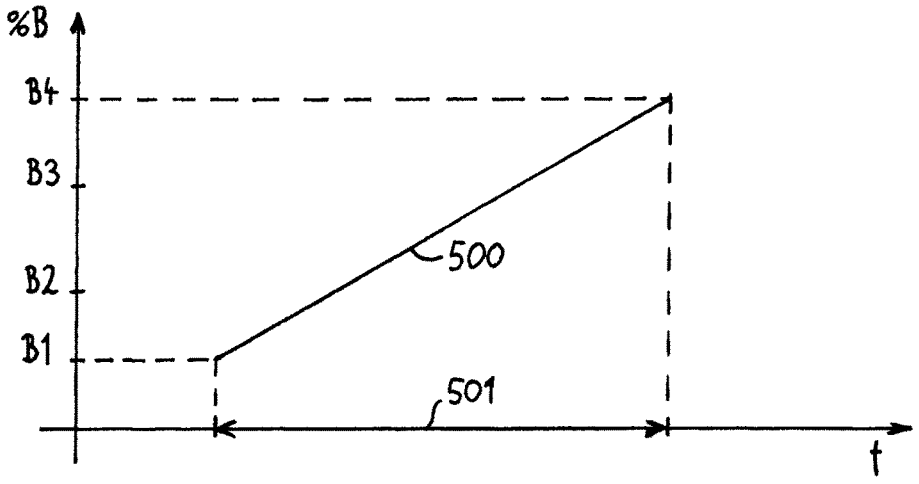
FIG. 5 illustrates how the frequencies and stroke lengths of the first and the second pump unit are varied to produce a continuous solvent gradient.

FIG. 5A depicts a solvent gradient 500, whereby the percentage of solvent B in the composite solvent is indicated as a function of time. During a time interval 501, the percentage of solvent B is linearly increased from an initial concentration B1 to a final concentration B4.

Figure 5B:
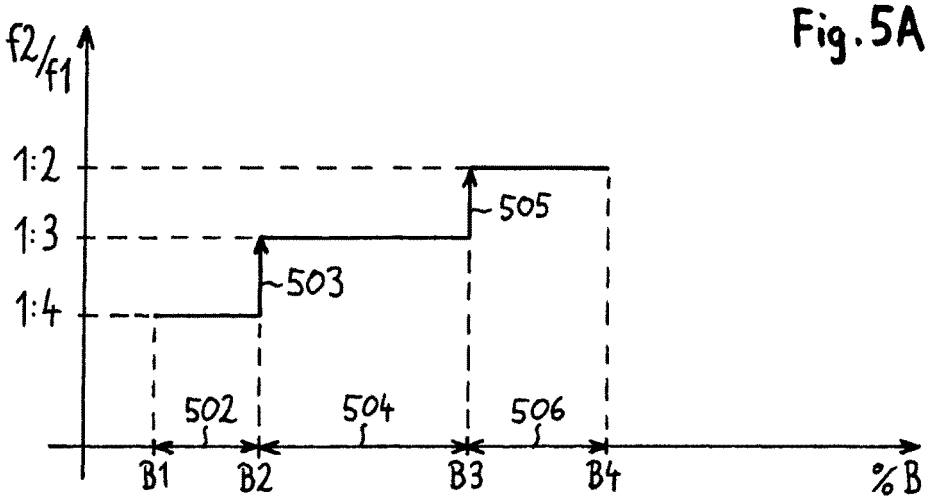
Figure 5C:
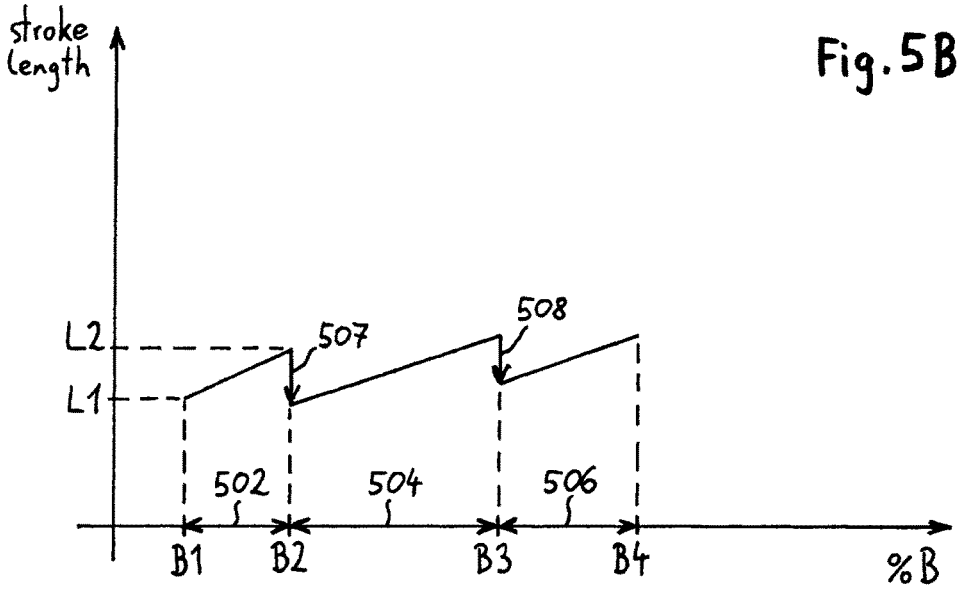

In FIGS. 5B and 5C, it is illustrated how the solvent gradient 500 shown in FIG. 5A can be generated under the restriction of predefined frequency relationships between the frequency f1 of the first pump unit 101 and the frequency f2 of the second pump unit 104.

FIG. 5B shows the ratio of the frequencies f2/f1 as a function of the percentage of solvent B. FIG. 5C shows the stroke length of the second pump unit's pistons as a function of the amount of solvent B.

For small amounts of solvent B, the frequency f1 of the first pump unit is significantly larger than the frequency f2 of the second pump unit. To give an example, in the interval 502 ranging from B1 to B2, f2/f1 may be equal to 1:4. As the percentage of solvent B becomes larger, the frequency ratio f2/f1 is changed in steps. At a percentage B2 of solvent B, the ratio f2/f1 is changed from 1:4 to 1:3 in a step 503. In the interval 504 ranging from B2 to B3, the ratio f2/f1 is kept at 1:3. At a percentage B3 of solvent B, the frequency ratio is changed from 1:3 to 1:2 in a step 505. In the interval 506 ranging from B3 to B4, the ratio f2/f1 is kept at 1:2. Hence, as illustrated in FIG. 5B, the frequencies f1 and f2 are not varied continuously as in prior art solutions, but in frequency steps.

However, for providing a continuous gradient of composite solvent, it is necessary to continuously increase the respective solvent flow delivered by the second supply flow path, while decreasing at the same time the flow from the first supply flow path. FIG. 5C shows the stroke length of the second pump unit's pistons as a function of the amount of solvent B. As can be seen from FIG. 5C, a continuous variation of the respective amount of solvent B is accomplished by varying the stroke length of the second pump unit's pistons.

For example, in the interval 502, the frequencies f1 and f2 are kept constant, but the stroke length of the second pump unit's pistons is linearly increased from an initial stroke length L1 to a final stroke length L2.

Then, at the percentage B2, the frequency ratio f2/f1 is changed from 1:4 to 1:3. In order to provide a continuously increasing flow of solvent B, a corresponding step 507 is imposed onto the stroke length of the second pump unit's pistons. The stroke length of the second pump unit's pistons is controlled such that the increase of f2/f1 is compensated by a corresponding decrease of the stroke length.

In the interval 504 from B2 to B3, the stroke length of the second pump unit's pistons again is linearly increased.

At the concentration B3, the frequency ratio f2/f1 is changed again, and a corresponding step 508 is applied to the stroke length. The increase of f2 relative to f1 is compensated by a corresponding decrease of the stroke length of the second pump unit's pistons. By increasing the frequency f2 and simultaneously decreasing the stroke length, a continuous variation of the flow of solvent B is accomplished.

As illustrated in FIGS. 5A to 5C, it is possible to supply a continuously varying flow relation of solvent A and B under the restriction of predefined frequency relationships between the respective frequencies f1 and f2 of the pump units. This is accomplished by varying the stroke lengths accordingly. For example, for a piston pump used in the field of analytical HPLC applications, the stroke volume may be varied between 10 μl and 100 μl.

Figure 6:
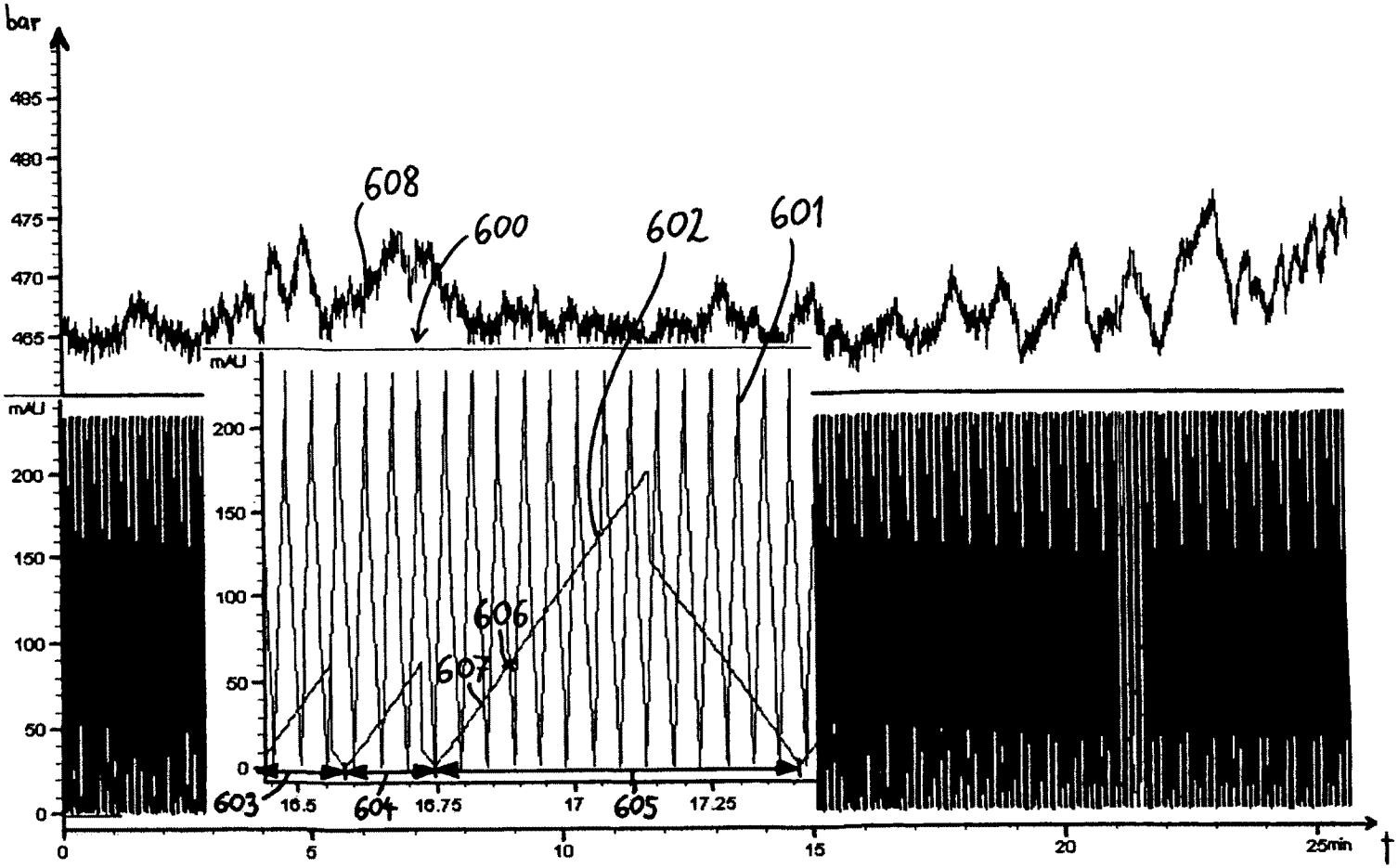
FIG. 6 shows how a transition of the second pump unit's stroke volume and frequency is performed.

FIG. 6 shows how a transition of the second pump unit's stroke volume and frequency is performed. In the lower part of FIG. 6, a window 600 is shown that provides a magnified view of the piston movements in the first and the second pump unit, respectively. Curve 601 shows piston position as a function of time for the first pump unit 101, and curve 602 shows piston position as a function of time for the second pump unit 104. Both in curve 601 and in curve 602, each pump cycle comprises an intake phase, a compression phase and a delivery phase. From the diagram in window 600, it can be seen that throughout window 600, the pump cycle T1 of the first pump unit is kept constant, with the first pump unit operating at a frequency f1=1/T1.

With regard to the pump cycle of the second pump unit, a transition of the second pump unit's stroke volume is observed. During the first two pump cycles 603 and 604, the stroke volume is equal to 5 μl. During the third pump cycle 605, the stroke volume is increased by a factor of four, with the new stroke volume being equal to 20 μl. At the point 606 of the intake phase 607, the direction of movement of the second pump unit's piston is not reversed yet. Instead, the second pump unit continues to draw in solvent. Accordingly, the intake phase 607 is prolonged.

The time period of pump cycle 603 is equal to T2, and the time period of pump cycle 604 is also equal to T2. In the third pump cycle 605, the time period is changed to T2'. The time period T2' of pump cycle 605 is four times as large as the time period T2 of the previous pump cycles 603 and 604. Correspondingly, compared to the frequency f2, the frequency f2'=1/T2' is reduced by a factor of four.

In the upper part of FIG. 6, the pressure at the outlet of the second pump unit is depicted as a function of time. Pressure trace 608 indicates the pressure in bar as a function of time. It can be seen from the pressure trace 608 in FIG. 6 that applying a "frequency step" does not involve any discontinuity. Decreasing and increasing the frequency of the pump unit (here at point 606 at the time point of 16.9 minutes) can be effected by varying the length of the intake phase. It can further be seen from the pressure trace 608 in FIG. 6 that the transition from an initial stroke volume of 5 μl to a stroke volume of 20 μl, which occurs at point 606 at the time point of 16.9 minutes, does not affect the pressure at the outlet of the second pump unit. Furthermore, the increase of the stroke volume does not affect the magnitude of the pressure fluctuations. Hence, varying the stroke volume as proposed by embodiments of the present invention does not cause any pressure discontinuities.

For realizing a scheme for generating a solvent gradient as shown in FIGS. 5A to 5C, the points where the frequency steps and the changes of the stroke volume occur may be defined beforehand. For example, when programming a gradient 500 as shown in FIG. 5A, the respective concentrations B2 and B3 where the frequency ratio and the stroke volume change may be defined by the programmer.

However, instead of predefining the points where the frequency ratio and the stroke volume change, these points may as well be determined during the pump unit's operation. For example, during each pump cycle of the pump unit that operates at the higher one of the frequencies f1 and f2, it is determined whether the pump that operates at the lower frequency has already drawn in a sufficient amount of solvent or not.

Figure 7:
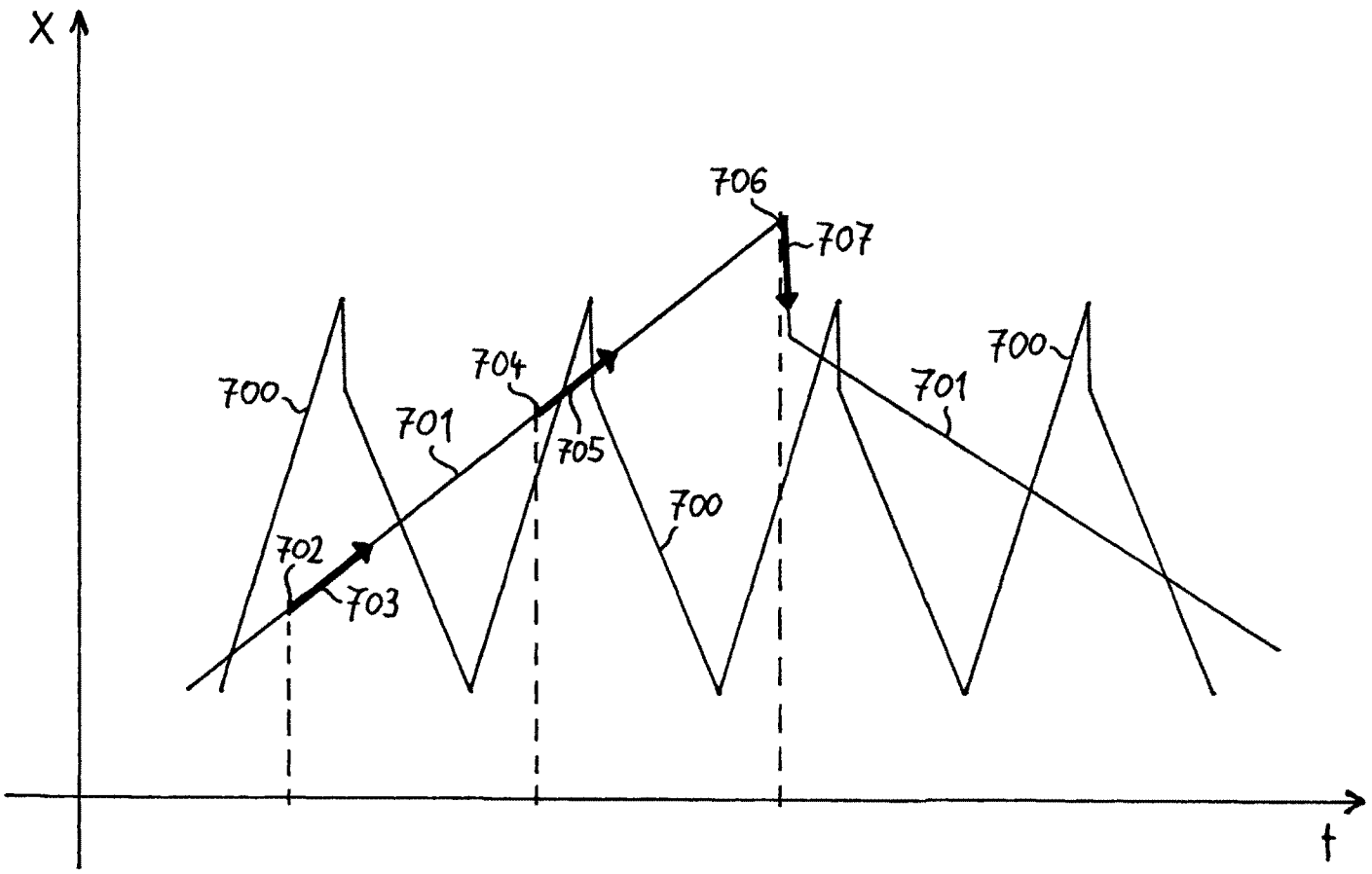
FIG. 7 illustrates how the respective timing of the first pump unit's operation and the second pump unit's operation is coordinated.

FIG. 7 illustrates how the respective timing of the first pump unit's operation and the second pump unit's operation is coordinated. Both for the first pump unit (curve 700) and for the second pump unit (curve 701), piston position X is shown as a function of time.

In each pump cycle of the faster cycling pump, in this case of the first pump unit 101, it is determined, preferably at the center of the intake phase, whether a sufficient amount of solvent has been drawn in by the piston of the second pump unit 104 or not. For example, in each pump cycle of the first pump unit, it may be determined whether the volume drawn in by the second pump unit has already reached a threshold of 10 μl or not. At point 702, the second pump unit's piston has not drawn in a sufficient amount of solvent yet, and therefore, as indicated by arrow 703, the intake phase is continued. Also at point 704, the second pump unit's piston has not drawn in a sufficient amount of solvent yet, and therefore, as indicated by arrow 705, the intake phase is continued. At point 706, a sufficient amount of solvent has been drawn in, and therefore, the intake phase is ended, the direction of piston movement is changed, and, as indicated by arrow 707, the compression and delivery phase is started.

So far, the effects due to interference of the frequencies of the first pump unit and the second pump unit have been explained for the example of a dual-piston serial type pump as shown in FIG. 1. However, heterodyne beats occur whenever two or more pump units are used that operate periodically at different frequencies, with the frequencies f1 and f2 of the pump units being varied independently of one another.

For example, according to an alternative embodiment, both the first pump unit of the first solvent delivery line and the second pump unit of the second solvent delivery line may be realized as dual-piston parallel type pumps.

Figure 8A:
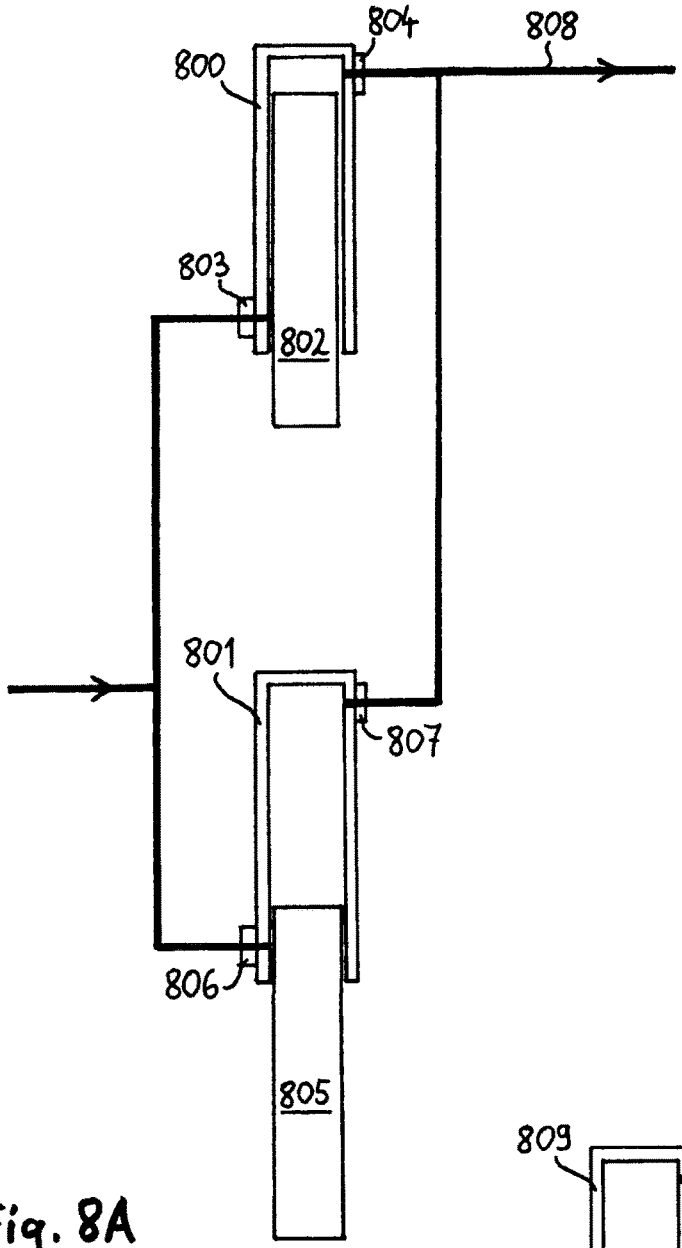
FIG. 8 shows a dual-piston parallel type pump and a single-piston pump as further examples of periodically operating pump units.

FIG. 8A shows a dual-piston parallel type pump with a first pump head 800 and a second pump head 801 arranged in parallel in the flow stream. The first pump head 800 comprises a first piston 802, an inlet valve 803 and an outlet valve 804. The second pump head 801 comprises a second piston 805, an inlet valve 806 and an outlet valve 807. The inlets of the first and the second pump head 800, 801 are connected in parallel, and the outlets of the first and the second pump head 800, 801 are also connected in parallel.

The first pump head 800 and the second pump head 801 operate essentially 180° out of phase. Hence, an intake phase of first pump head 800 coincides with a delivery phase of the second pump head 801, and vice versa. During an intake phase of the first pump head 800, the first piston 802 moves in the downwards direction, and solvent is drawn into the first pump head 800. Meanwhile the second piston 805 of the second pump head 801 moves in the upwards direction and delivers solvent via a common solvent delivery line 808.

Then, during the first pump unit's delivery phase, the first piston 802 of the first pump head 800 moves upwards and supplies solvent via the common solvent supply line 808. The second piston 805 of the second pump head 801 moves downwards, and solvent is drawn into the second pump head 801.

In case the first pump unit comprises a dual-piston parallel type pump operating at a first frequency f1 and the second pump unit comprises a dual-piston parallel type pump operating at a second frequency f2, it may be advantageous to adjust the frequencies f1 and f2 relative to one another. To avoid interference, it may e.g. be advantageous to establish well-defined frequency relationships between the frequencies f1 and f2. For example, for predefined intervals of solvent composition, the frequency ratio f2/f1 may be set to a ratio m/n of two small integer numbers m and n.

Figure 8B:
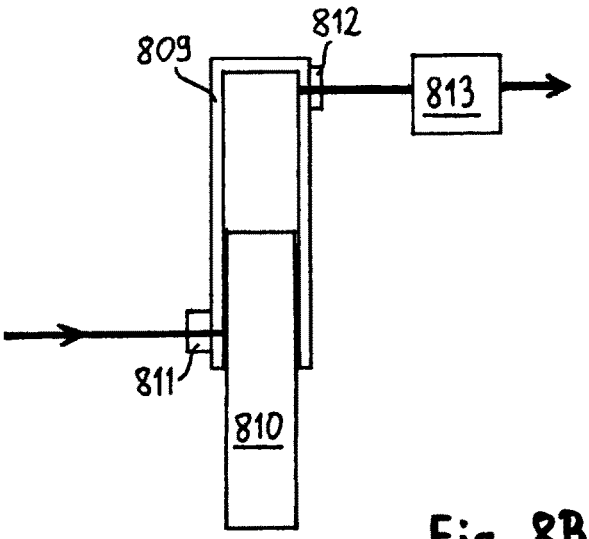

According to yet another embodiment, both the first pump unit and the second pump unit may be realized as single-piston pumps. In FIG. 8B, a single-piston type pump is shown. The single-piston pump comprises a pump chamber 809 with a piston 810, an inlet valve 811 and an outlet valve 812. To provide for a continuous flow of solvent, the piston pump may be connected in series with a dampening unit 813 that provides a flow of solvent during the intake phase of the single-piston pump. Preferably a so-called fast-refill motion is employed to shorten the intake phase, which then reduces the required damping volume.

In case the first pump unit comprises a single-piston pump operating at a first frequency f1 and the second pump unit comprises a single-piston pump operating at a second frequency f2, it may be advantageous to adjust the frequencies f1 and f2 relative to one another. The frequency f1 of the first pump unit and the frequency f2 of the second pump unit may e.g. be synchronized relative to one another. For predefined intervals of solvent composition, the frequency ratio f2/f1 may e.g. be set to a ratio m/n of two small integer numbers m and n.

Embodiments of the invention are not limited to the pump types depicted in FIGS. 1 and 8A, 8B. Instead, any other periodically operating pump or a combination of different types may be used as well.

So far, it has been described how the accuracy can be improved by synchronizing the frequencies of pump units in the first and the second supply flow path. Additionally or alternatively, the phase relation between a first pump unit in a first solvent delivery path and a second pump unit in a second solvent delivery path may be taken care of.

Figure 9:
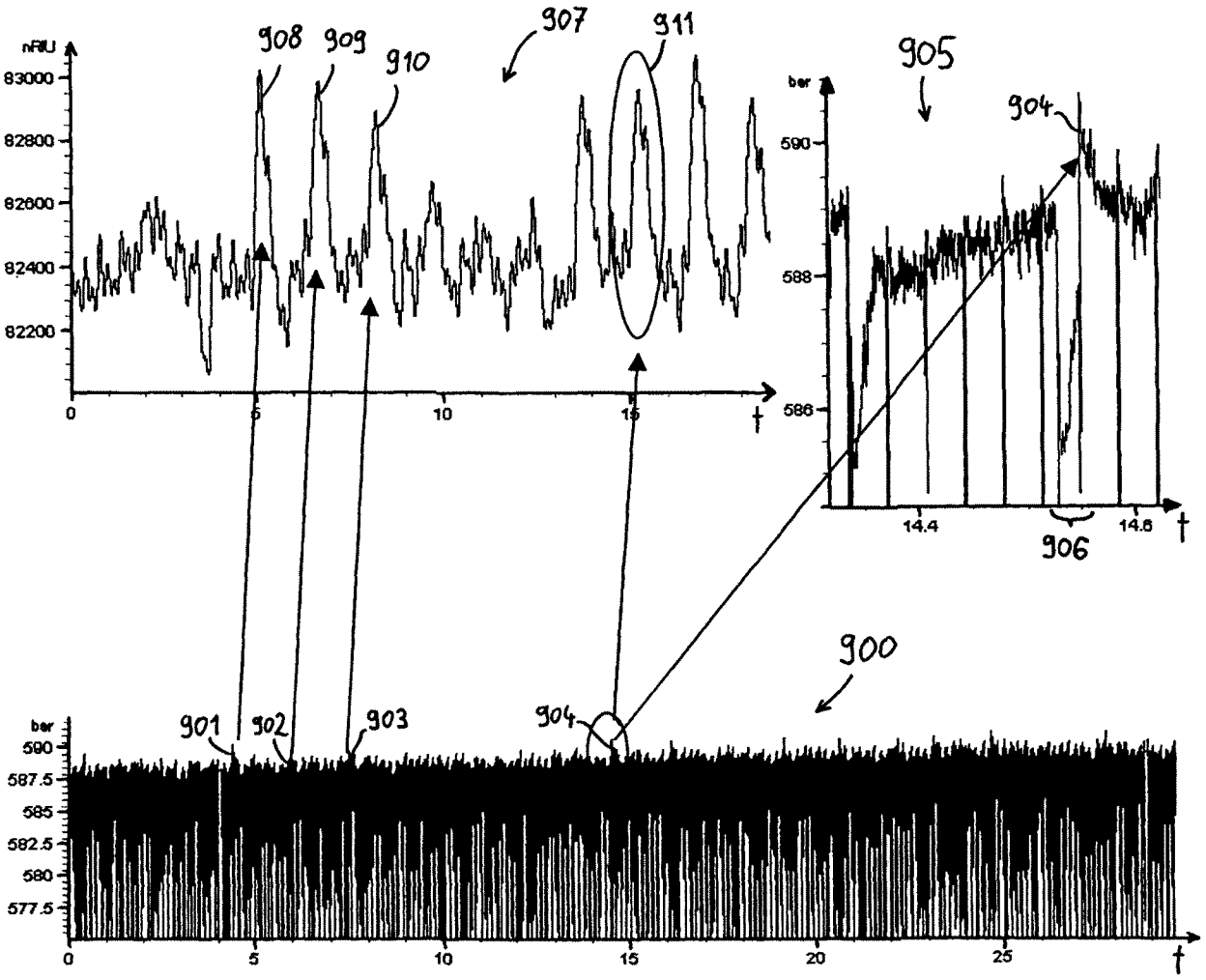
FIG. 9 depicts pressure peaks and fluctuations of solvent composition that are due to unfavourable phase correlations.

An example of the effects caused by unfavourable phase relations is illustrated in FIG. 9. The diagram 900 in the lower part of FIG. 9 shows the pressure at the outlet of the solvent supply system as a function of time, with a large number of pump cycles being depicted along the time axis of 30 minutes. It can be seen that the pressure does not fluctuate much and remains quite stable. However, once in a while, pressure peaks 901 to 904 can be observed.

In the diagram 905 in the upper right of FIG. 9, a magnified view of the pressure peak 904 is given. It can be seen that the pressure peak 904 in the pump cycle 906 differs from the pressure variations in neighboring pump cycles.

In the diagram 907 in the upper left of FIG. 9, a refractive index signal of the composite solvent is shown as a function of time. The refractive index signal is given in refractive index units (RIUs), as determined by a refractive index detection instrument. The refractive index signal indicates solvent composition. It can be seen that the pressure peaks 901 to 904 shown in diagram 900 are closely related to corresponding fluctuations 908 to 911 of solvent composition shown in diagram 907.

The pressure peaks 901 to 904 and the fluctuations 908 to 911 of solvent composition are due to unfavourable phase relations between the first pump unit and the second pump unit. According to embodiments of the present invention, it is proposed to coordinate operation of the first and the second pump unit in a way that unfavourable phase relations are avoided. For example, phase relations that are likely to cause problems may be determined empirically. Then, the piston movements of the first and the second pump unit may be controlled in a way that these unfavourable phase relations are prevented. For example, at least one of stroke length and frequency of the first and the second pump unit may be controlled in a way that these predefined phase correlations do not occur. As a consequence, both the pressure peaks 901 to 904 shown in diagram 900 and the fluctuations 908 to 911 of solvent composition shown in diagram 907 are avoided.

Figure 10:
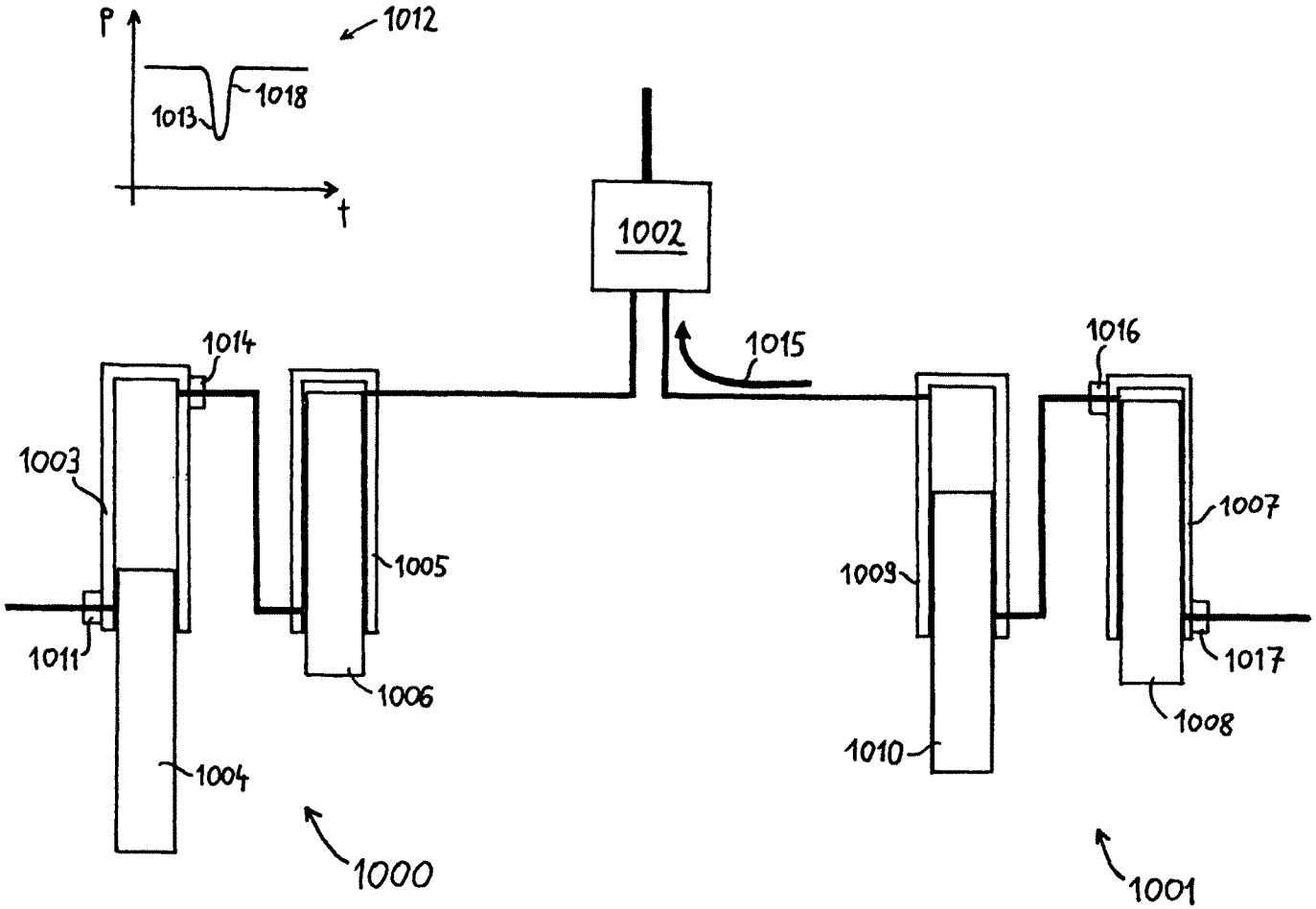
FIG. 10 shows a solvent supply system, in which an unfavourable phase correlation between the pump units leads to a fluctuation of solvent composition.

In the following, an example for an unfavourable phase correlation between a first pump unit and a second pump unit will be explained. FIG. 10 illustrates the effects that are due to an unfavourable phase correlation between a first pump unit 1000 and a second pump unit 1001 in a solvent supply system. The first pump unit 1000 is adapted for supplying a flow of solvent A to a mixing unit 1002, and the second pump unit 1001 is adapted for supplying a flow of solvent B to the mixing unit 1002. In this embodiment, the first pump unit 1000 is a dual-piston serial type pump comprising a primary pump head 1003 with a primary piston 1004 and a secondary pump head 1005 with a secondary piston 1006 arranged in series. The second pump unit 1001 also comprises a primary pump head 1007 with a primary piston 1008 and a secondary pump head 1009 with a secondary piston 1010 arranged in series.

Problems arise in particular when the pistons of the first pump unit 1000 are essentially 180° out of phase with the pistons of the second pump unit 1001. This situation is depicted in FIG. 10. At the first pump unit 1000, the primary piston 1004 of the primary pump head 1003 is at its bottom dead center, whereas at the second pump unit 1001, the primary piston 1008 of the primary pump head 1007 is at its upper dead center, which is about 180° out of phase with the primary piston 1004 of the first pump unit's primary pump head 1003.

After a volume of solvent A has been drawn in by the primary piston 1004, the inlet valve 1011 is closed, the piston 1004 starts moving upwards, and the secondary piston 1006 of the secondary pump head 1005 starts moving downwards. However, as indicated in diagram 1012, there may be a short pressure drop 1013 between the end of the delivery phase of the secondary piston 1006 and the beginning of the delivery phase of the primary piston 1004. The reason for this pressure drop 1013 is that it takes some time until a system pressure that is sufficient for opening the outlet valve 1014 is built up in the primary pump head 1003. For a solvent supply system adapted for supplying a composite solvent at a pressure of several hundred or even more than thousand bar, the pressure drop 1013 (although as short as 15 msec) may e.g. be equal to 30 bar.

At the second pump unit 1001, the primary piston 1008 has reached an upper dead center after having delivered a flow of solvent B during its upward stroke. The secondary piston 1010 has reached its bottom dead center. Now, the sudden pressure drop 1013 of the first pump unit 1000 is coupled via the mixing unit 1002 to the primary and the secondary pump head 1007, 1009 of the second pump unit 1001. As a consequence, the solvent in the solvent B flow path expands, and due to this expansion, the primary and the secondary pump head 1007, 1009 dispense an extra volume 1015 of solvent B to the mixing unit 1002. This extra volume 1015 may e.g. be in the order of about 0.5 μl. It is assumed that the phase relation between the first and the second pump unit is such that the pressure drop 1013 occurs at a point of time where the outlet valve 1016 of the second pump unit's primary pump head 1007 is still open. The inlet valve 1017 is still closed.

Immediately after the pressure drop 1013, there is a corresponding pressure increase 1018 in the solvent A flow path, because system pressure is brought back to its former level within a 15 msec timeframe. Via the mixing unit 1002, this pressure increase 1018 is coupled to the solvent B flow path, and accordingly, the solvent contained in the solvent B flow path is compressed. However, the outlet valve 1016 of the primary pump head 1007 is already closed now, and therefore, it is not possible to push a volume of solvent B back into the primary pump head 1007.

In general, the effects caused by the pressure drop 1013 are intrinsically compensated by the effects that on the subsequent pressure increase 1018 the primary piston 1008 of the second pump unit 1001 has to displace volume to increase inner pressure before the pump continues to deliver, but for the phase correlation shown in FIG. 10, this compensation does not work, because the outlet valve 1016 continues to be closed while the secondary piston 1010 already delivers. Hence, for the phase correlation shown in FIG. 10, the second pump unit 1001 dispenses an extra volume 1015 of solvent B. Hence, for the phase correlation shown in FIG. 10, the overall volume of solvent B dispensed by the second pump unit 1001 is too large for this specific individual pump cycle.

As a consequence, in case of a phase correlation as shown in FIG. 10, an overshoot of system pressure is observed right after the pressure drop 1013. Furthermore, the total amount of solvent B dispensed by the second pump unit 1001 is larger than it is supposed to be, which gives rise to an error of solvent composition that now is distributed through the system.

Hence, the effect described in FIG. 10 causes both pressure peaks and fluctuations of solvent composition. This provides an explanation of the pressure peaks 901 to 904 and the fluctuations 908 to 911 of solvent composition shown in FIG. 9. In fact, the pressure peaks 901 to 904 and the fluctuations 908 to 911 of solvent composition shown in FIG. 9 are due to the effects explained in FIG. 10.

The phase correlation shown in FIG. 10 occurs when the upper dead center of the first pump unit's primary piston coincides with the bottom dead center of the second pump unit's primary piston, or vice versa. Hence, the phase correlation shown in FIG. 10 occurs when the first pump unit's primary piston is about 180° out of phase with the second pump unit's primary piston.

A phase correlation of the type shown in FIG. 10 has to be avoided. According to embodiments of the present invention, the piston movements of the first pump unit 1000 and the second pump unit 1001 are controlled in a way that any kind of unfavourable phase correlation is avoided. For this purpose, the respective piston movements of the first and the second pump unit 1000, 1001 are controlled such that unfavourable phase correlations do not occur. For example, unfavourable phase correlations may be determined empirically, and then, the pistons are controlled in a way that these predetermined phase correlations are avoided. For example, by shortening or extending a piston stroke, or by increasing or decreasing a frequency of operation of at least one of the pump units 1000, 1001, it is possible to prevent unfavourable phase correlations.

So far, it has been described how unfavourable frequency relations and unfavourable phase relations can be avoided. In addition to this, regions of preferred phase relations and/or preferred frequency relations between the pump units may be identified. Within these "sweet spots" of preferred phase and frequency relations, a stable operation of the solvent supply system is possible. In particular, when the solvent supply system is operated in these "sweet spot" regions of preferred phase and frequency relations, quality and reliability of the composite solvent obtained at the outlet of the solvent supply system is improved.

The invention claimed is:

1. A solvent supply system for supplying a composite solvent, the solvent supply system comprising:

a mixing unit comprising an outlet;

a first supply flow path with a first pump unit, the first supply flow path configured for supplying a flow of a first solvent to the mixing unit, the first pump unit operating periodically a second supply flow path with a second pump unit, the second supply flow path configured for supplying a flow of a second solvent to the mixing unit, the second pump unit operating periodically the mixing unit configured for mixing the first solvent and the second solvent and for supplying a composite solvent at the outlet, the composite solvent having a solvent composition comprising the first solvent and the second solvent and a control unit configured for controlling operations of the first pump unit and the second pump unit, including controlling a frequency ratio of a first frequency of the first pump unit and a second frequency of the second pump unit, the first frequency and the second frequency comprising different frequencies, wherein the frequency ratio is a ratio of integer numbers, such that heterodyne beats caused by an interference of the first frequency and the second frequency, and fluctuations in the solvent composition at the outlet, are avoided.

2. The solvent supply system of claim 1, wherein a relative phase is determined empirically.

3. The solvent supply system of claim 1, wherein:

each of the first and the second pump unit comprises at least one piston pump; and the control unit is adapted to shorten or extend a piston stroke of at least one of the first pump unit and the second pump unit.

4. The solvent supply system of claim 1, wherein the first pump unit and the second pump unit are dual-piston type pumps, each comprising two piston pumps, wherein the two piston pumps are either:

operating in parallel; or fluidically connected in series.

5. The solvent supply system of claim 1, wherein the control unit is further adapted for varying a flow rate of at least one of the first pump unit and the second pump unit by continuously varying a stroke volume of at least one of the first pump unit and the second pump unit.

6. The solvent supply system of claim 1, wherein:

the first pump unit is driven by a first drive;

the second pump unit is driven by a second drive; and the control unit is adapted for synchronizing respective periodic operations of the first and second pump units by controlling at least one of the first drive and the second drive.

7. A separation system comprising:

a solvent supply system according to claim 1, the solvent supply system being adapted for supplying a composite solvent; and a separation device adapted for separating compounds of a fluid sample, said fluid sample being introduced to the composite solvent supplied by the solvent supply system.

8. A method for supplying a composite solvent, the method comprising:

supplying a first solvent to a mixing unit via a first supply path, the first supply path comprising a first pump unit operating periodically supplying a second solvent to the mixing unit via a second supply path, the second supply path comprising a second pump unit operating periodically mixing the first solvent supplied from the first supply path and the second solvent supplied from the second supply path in the mixing unit to produce a composite solvent having a solvent composition comprising the first solvent and the second solvent at an outlet of the mixing unit, and controlling operation of the first pump unit and the second pump unit, wherein controlling comprises:

controlling a frequency ratio of a first frequency of the first pump unit and a second frequency of the second pump unit, the first frequency and the second frequency comprising different frequencies, wherein the frequency ratio is a ratio of integer numbers, such that heterodyne beats caused by an interference of the first frequency and the second frequency, and fluctuations in the solvent composition at the outlet, are avoided.

9. The method according to claim 8, comprising adjusting a phase of the first pump unit and the phase of the second pump unit relative to one another in accordance with a predetermined parameter range.

10. The solvent supply system of claim 1, comprising controlling a frequency ratio of a first frequency of operation of the first pump to a second frequency of operation of the second pump in accordance with a predetermined parameter range.

11. The solvent supply system of claim 10, wherein the control unit is further adapted for at least one of:

keeping the first frequency and the second frequency constant over predefined intervals of the flow rate;

discontinuously varying at least one of the first frequency and the second frequency in frequency steps, wherein for predefined intervals of the rate, at least one of the first frequency and the second frequency is kept constant; and changing at least one of the first frequency and the second frequency by a frequency step when the stroke volume meets a predetermined threshold.

12. The method according to claim 10, comprising controlling the frequency ratio such that the frequency ratio is equal to a ratio of integer numbers greater than 1.

13. The method according to claim 8, comprising controlling a frequency ratio of a first frequency of operation of the first pump to a second frequency of operation of the second pump such that the frequency ratio is in accordance with a predetermined parameter range.

14. A solvent supply system for supplying a composite solvent, the solvent supply system comprising:

a mixing unit comprising an outlet;

a first supply flow path with a first pump unit, the first supply flow path configured for supplying a flow of a first solvent to the mixing unit, the first pump unit operating periodically a second supply flow path with a second pump unit, the second supply flow path configured for supplying a flow of a second solvent to the mixing unit, the second pump unit operating periodically the mixing unit configured for mixing the first solvent and the second solvent and for supplying a composite solvent at the outlet, the composite solvent having a solvent composition comprising the first solvent and the second solvent, and a control unit configured for controlling operation of the first pump unit and the second pump unit, including controlling a frequency ratio of a first frequency of the first pump unit and a second frequency of the second pump unit, the first frequency and the second frequency comprising different frequencies, wherein the frequency ratio is a ratio of integer numbers, such that least one of fluctuations in the solvent composition and pressure peaks in the outlet of the mixing unit are avoided.

15. The solvent supply system of claim 14, wherein a phase relations are determined empirically.

16. The solvent supply system of claim 14, wherein adjusting a phase of the first pump unit and a phase of the second pump unit relative to one another is done in accordance with a predetermined parameter range.

17. The solvent supply system of claim 14, wherein:

each of the first pump unit and the second pump unit comprises at least one piston pump; and the control unit is adapted to shorten or extend a piston stroke of at least one of the first pump unit and the second pump unit for adjusting the phase of the first pump unit and the phase of the second pump unit relative to one another.

18. The solvent supply system of claim 14, wherein the control unit is configured for adjusting a phase of the first pump unit and a phase of the second pump unit relative to one another to prevent dispensing of at least one of an extra volume of first solvent from the first supply path into the mixing unit or an extra volume of second solvent from the second supply path into the mixing unit.

19. A solvent supply system for supplying a composite solvent, the solvent supply system comprising:

a mixing unit comprising an outlet;

a first supply flow path with a first pump unit, the first supply flow path configured for supplying a flow of a first solvent to the mixing unit, the first pump unit operating periodically a second supply flow path with a second pump unit, the second supply flow path configured for supplying a flow of a second solvent to the mixing unit, the second pump unit operating periodically the mixing unit configured for mixing the first solvent and the second solvent and for supplying a composite solvent at the outlet, the composite solvent having a solvent composition comprising the first solvent and the second solvent, and a control unit configured for synchronizing respective operations of the first pump unit and the second pump unit, wherein the control unit is configured for controlling a frequency ratio of a first frequency of the first pump unit and a second frequency of the second pump unit, the first frequency and the second frequency comprising different frequencies, wherein the frequency ratio is a ratio of integer numbers, such that heterodyne beats caused by an interference of the first frequency and the second frequency, and fluctuations in the solvent composition at the outlet, are avoided, and the control unit is further configured for varying a flow rate of at least one of the first pump unit and the second pump unit by continuously varying a stroke volume of at least one of the first pump unit and the second pump unit, and discontinuously varying at least one of the first frequency and the second frequency in frequency steps.

* * * * *